United States Patent [19]

Camp

[11] Patent Number: 4,990,307

[45] Date of Patent: Feb. 5, 1991

[54] METHOD FOR PRODUCING PARTICLES FOR THE PRODUCTION OF PERMANENT MAGNETS

[75] Inventor: Floyd E. Camp, Trafford, Pa.

[73] Assignee: Crucible Materials Corporation, Pittsburgh, Pa.

[21] Appl. No.: 171,775

[22] Filed: Mar. 22, 1988

[51] Int. Cl.[5] ..... B22F 9/18

[52] U.S. Cl. ..... 419/30; 75/352; 75/359; 75/364; 148/301; 148/302

[58] Field of Search ..... 148/104, 105, 301, 302; 419/30; 75/0.5 BA, 0.5 AA, 101 R, 121, 352, 359, 364, 610; 252/62.55, 62.56, 62.57, 62.58, 62.63

[56] References Cited

U.S. PATENT DOCUMENTS

| | | | |
|---|---|---|---|
| 3,826,696 | 7/1974 | Cech | 148/105 |
| 4,689,073 | 8/1987 | Nate et al. | 75/0.5 BA |
| 4,806,155 | 2/1989 | Camp et al. | 75/0.5 AA |

*Primary Examiner*—John P. Sheehan

*Attorney, Agent, or Firm*—Finnegan, Henderson, Farabow, Garrett & Dunner

[57] ABSTRACT

Particles for the production of permanent magents are obtained by producing an article having Ca and a rare earth oxide including at least Nd oxide. The article is heated to effect Ca rare earth oxide reduction. Thereafter, particles of −60 mesh or finer are formed from this article. Leaching of Ca from the particles is achieved by contacting the particles with an organic acid having at least 3 carbon atoms, preferably propionic or butanoic acid.

14 Claims, No Drawings

METHOD FOR PRODUCING PARTICLES FOR THE PRODUCTION OF PERMANENT MAGNETS

BACKGROUND OF THE INVENTION

1. Field of the Invention

This invention relates to the production of alloy particles for consolidation to produce permanent magnets.

2. Description of the Prior Art

Sintered permanent magnets are produced by practices that include the consolidation and high-temperature sintering of particles constituting the desired alloy composition of the magnet. In the production of sintered permanent magnets including light rare earth elements, and particularly Nd, the particles are produced by a reduction-diffusion practice that includes the use of calcium as the reductant.

In the conventional reduction-diffusion processes for producing particles of permanent magnet alloy, including Nd, for use in consolidation to produce sintered magnets, initially particles of the desired alloy composition and calcium particles are consolidated, as by cold isostatic pressing, to form a bar. The bar is heated for a time at temperature to achieve the desired calcium reduction of the particles of rare earth oxides incorporated in the bar. During this heat treatment, in addition to the calcium reduction of ( The rare earth oxides, the rare earth element, namely Nd, is diffused into the grain boundaries to form a Nd-rich grain boundary phase. It is this phase that is significant n achieving good magnetic properties, particularly coercivity, in magnets subsequently produced from this material Upon the connection of heat treatment, the bar is comminuted, as by a crushing operation, to produce particles therefrom. The particles are usually of -30 mesh (U.S. Standard). The particles resulting from this operation have significant amounts of calcium oxide resulting from the calcium reduction reaction. Conventionally, the calcium oxide is removed by a combination of initial water washing followed by leaching with acetic acid. Mineral acids such as hydrochloric acid and nitric acid are also conventionally used for this purpose.

Applicant has determined that during this acid leaching step significant amounts of the rare earth element, namely Nd, are dissolved to leave the Nd-rich grain boundary phase deficient in Nd. Applicant has further determined that this results in a degradation of the magnetic properties of magnets subsequently made from this material. Specifically in this regard, applicant has conducted experimental work demonstrating that with a conventional reduction-diffusion process for the conventional magnet alloy of NdFeB that acetic acid leaching has the following effect on the composition of the particles:

| | Nd | Dy | Fe | B | Ca | $O_2$ |
|---|---|---|---|---|---|---|
| Nominal Composition Weight % | 32.0 | 2.6 | 64.1 | 1.3 | 0 | 0 |
| Analyzed Composition Weight % | 26.5 | 2.5 | 65.9 | 1.3 | .16 | 0.75 |

As may be seen from this analysis of the prior-art practice, a significant amount of Nd (17%) is lost during acetic acid leaching to result in a material that is close to the composition of the $Nd_2Fe_{14}B$ matrix phase (26.8% Nd, 72% Fe, 1.0% B).

SUMMARY OF THE INVENTION

Broadly in accordance with the method of the invention particles for the production of permanent magnets are obtained by producing an article having Ca and a rare earth oxide including at least Nd oxide. The article is heated to effect Ca reduction of the rare earth oxide. Thereafter, particles of −60 mesh or finer are formed from the article. Leaching of Ca from the particles is achieved by contacting the particles with an organic acid having at least 3 carbon atoms, preferably propionic (propanoic) acid or butanoic acid. The particles are water rinsed prior to this leaching operation.

In the production of consolidated magnet articles by sintering, in accordance with the invention, the sintering operation may be performed without the use of a sintering aid.

The article that is heated to effect calcium reduction in accordance with the invention may also contain a transition element and B. The transition element may be Fe. The article may also include Dy oxide which is also calcium reduced during the heating step incident to Ca reduction.

DETAILED DESCRIPTION OF THE PREFERRED EMBODIMENTS

Reference will now be made in detail to presently preferred embodiments of the invention, examples of which are described below. In the examples and throughout the specification and claims, all parts and percentages are in percent by weight unless otherwise specified. It is further understood that reference to the use of Ca for reduction includes the use of calcium-containing compounds.

The following specific examples demonstrate the effectiveness of the method of the invention in removing calcium oxide upon the completion of the reduction-diffusion process. Specifically in this regard they demonstrate that calcium and oxygen are effectively removed without significant dissolving of the Nd from the Nd-rich grain boundary phase. In this manner, the invention is effective for providing particles that when consolidated into a magnet body provide a magnet with a combination of is proved magnetic properties, particularly coercivity. By comparing Examples 1–3 with Examples 4–6, the significance of the combination of acid leaching in accordance with the invention and the use of finer than conventional particles from the standpoint of effective calcium and oxygen removal is clearly demonstrated.

EXAMPLE 1

The following ingredients were weighed, roller mixed, then cold isostatically pressed into a bar for heat treatment in an argon atmosphere:

1151 g Iron powder 70% −325 mesh
746 g $Nd_2O_3$ 95% Nd 5% other rare earths
69 g $Dy_2O_3$ 85% Dy 15% other rare earths
149 g FeB Ferroboron 17.5% B −100 mesh
375 g Ca 98% Atomized 0.2 to 2 micron particle size Heat treatment: A bar sample was introduced to a furnace maintained at 800° C. Upon temperature recovery, the temperature was increased to 1100° C. over 1.5 hours, held at 1100° C. for 10 hours and the sample was furnace cooled to ambient temperature. The cooled compact was jaw crushed and disc pulverized under a blanket of argon gas to a particle size of −30 mesh. 1057 g of this powder was then added to 2 liters of ice water, agitated, allowed to settle, then the $Ca(OH)_2$ slurry decanted off. Nine subsequent tap water washings were made in a similar manner. The addition of 323 ml of propionic acid brought the pH down from 12.2 to 8.5. The rate of acid usage is thus 30.6 ml/100 g powder. Several water rinses were then made followed with an isopropyl alcohol rinse to facilitate powder drying. The resulting material weighed 840 g for an overall material recovery of 98.9%. The nominal and analyzed compositions of this material are as follows:

| | RD-26-9 (weight percent) | |
|---|---|---|
| | Nominal | Analyzed |
| Nd | 32.0 | 31.7 |
| Dy | 2.6 | 2.7 |
| Fe | 64.1 | 63.7 |
| B | 1.3 | 1.2 |
| Ca | 0 | 0.41 |
| $O_2$ | 0 | 1.67 |
| $N_2$ | 0 | 0.0215 |
| C | 0 | 0.0945 |

With respect to Nd content, these are excellent results.

EXAMPLE 2

RD-26-10A (weight percent) An identical formulation was processed as in Example 1 having the following process parameters:

1000 g −30 mesh
367 ml propionic acid
36.7 ml acid/100 g powder
791 g recovered
98.5% recovery

| | Nominal | Analyzed |
|---|---|---|
| Nd | 32.0 | 31.4 |
| Dy | 2.6 | 2.6 |
| Fe | 64.1 | 63.8 |
| B | 1.3 | 1.25 |
| Ca | 0 | 0.125 |
| $O_2$ | 0 | 1.35 |
| $N_2$ | 0 | 0.016 |
| C | 0 | 0.0825 |

This powder was jet-milled to a particle size of 2.1 microns. Magnets were produced by cold isostatically pressing and sintering at 1035° C. for 3 hours. Those magnets with 0 and 5% sintering aid did not densify; however, those with 10 and 15% sintering aid did. The following magnetic properties were measured:

| Sample | Wt % Alloy 4 | Br Gauss | Hc Oe | Hci Oe | BHmax MGOe | Hk Oe |
|---|---|---|---|---|---|---|
| RD-26-10A | 10 | 11400 | 10700 | 13800 | 31.7 | 12200 |
| " | 15 | 11700 | 11100 | 13750 | 34.0 | 12200 |

Composition of sintering aid: 42% Nd, 57% Fe, 1%B.

EXAMPLE 3

A formulation similar to that of the sintering aid used in Example 2 was prepared according to the procedure of Example 2; the following process parameters were employed:

1000 g −30 mesh material
28.4 ml propionic acid /100 g powder
97.4% overall material recovery

| | RD-43-1 (weight percent) | |
|---|---|---|
| | Nominal | Analyzed |
| Nd | 42.0 | 39.2 |
| Fe | 56.7 | 58.5 |
| B | 1.3 | — |
| Ca | 0 | 0.14 |
| $O_2$ | 0 | 1.85 |

The calcium and oxygen levels shown in the previous examples tend to be higher than experienced in acetic acid processing of −30 mesh material. A sieve analysis on additional propionic acid reduction diffusion material established that the smaller size particles contained less oxygen (and presumably calcium) than the larger size particles. The overall analysis on this material was 31.7% Nd, 3.2% Dy, 56.9% Fe, 3.65% Ca and 4.0%. The data relating particle size and oxygen content are as follows

| | RD-42-5 (weight percent) |
|---|---|
| Sieve fraction | % Oxygen |
| +30 | 10.55 |
| −30 +60 | 6.15 |
| −60 +100 | 4.7 |
| −100 +200 | 1.7 |
| −200 +325 | 1.2 |
| −325 | 1.5 |

The following examples show the effect of pulverizing the reduction diffusion material to finer particle sizes with respect to calcium an oxygen removal. The most plausible explanation of this effect is that more sites containing CaO or excess Ca metal are exposed on finer particles which have larger surface areas than coarser particles. In the case of acetic acid processing, this effect is not easily observed since this acid dissolves and etches grain boundaries and thereby exposes additional CaO sites to be neutralized and removed. Propionic acid does very little dissolving and particle breakup. Consequently, more CaO sites are left entrapped within the larger particles, never to experience any leaching action by the acid.

The following examples show that propionic acid requirements are greatly reduced with finer particle sizes, suggesting that more of the Ca is being removed during the water washing steps. They also show that calcium and oxygen contents are lowered to an extent that permits magnets to be sintered with a reduction diffusion powder exclusive of any sinter aid addition. This is an ideal situation from an economic standpoint for producing NdFeB magnets using the least expensive form of rare earth raw materials.

EXAMPLE 4

The following ingredients were weighed, roller mixed, and cold isostatically pressed into a bar.

RD-26-14 (weight percent)

924 g Iron powder 70% −325 mesh
600 g $Nd_2O_3$ 95% Nd 5% other rare earths
55 g $Dy_2O_3$ 85% Dy 15% other rare earths
120 g FeB Ferroboron 17.5% B −100 mesh
301 g Ca 98% Atomized 0.2 to 2 micron particle size This formulation, as in all previous examples, includes 30% excess calcium over the stoichiometric amount required to reduce the rare earth oxides.

The heat treatment and washing procedures were identical to those described in Example 1. This material was disc pulverized under argon to a particle size fraction of −60 mesh. The following operating parameters were observed:

1812 g −60 mesh material
318 ml propionic acid
17.6 ml acid/100 g powder
1393 g recovered
95.7 recovery

| | Nominal | Analyzed |
|---|---|---|
| Nd | 32.0 | 31.3 |
| Dy | 2.6 | 2.6 |
| Fe | 64.1 | 63.9 |
| B | 1.3 | 1.2 |
| Ca | 0 | 0.04 |
| $O_2$ | 0 | 0.81 |

This powder was jet-milled to a particle size of 2.6 crons. A series of magnets with various sintering aid additions were cold isostatically pressed and sintered at 1045° C. for three hours. The sintering aid was of substantially the same composition as used in the previous examples. The magnetic properties were as follows:

| Sample | Wt % Sintering Aid | Br Gauss | Hc Oe | Hci Oe | BHmax MGOe | Hk Oe |
|---|---|---|---|---|---|---|
| RD-26-14 | 0 | 11750 | 10600 | 12900 | 33.1 | 10600 |
| " | 5 | 12000 | 10800 | 12600 | 35.2 | 10900 |
| " | 10 | 12100 | 10500 | 12100 | 35.9 | 10200 |

EXAMPLE 5

A revised composition was heat treated and pulverized to -60 mesh as previously described. The composition revision reflects slightly higher Nd and Dy contents and different sources of ferroboron and dysprosium oxide, but includes 30% excess calcium metal.

RD-48-1 (weight percent)

920 g Iron powder 70% −325 mesh
605 g $Nd_2O_3$ 95% Nd 5% other rare earths
57 g $Dy_2O_3$ 90% Dy 10% other rare earths
112 g 18.45% B −100 mesh
305 g Ca 98% Atomized 0.2 to 2 micron particle size The −60 mesh powder was divided into two parts. One half was processed for calcium removal with propionic acid, the other half was processed with butanoic (or butyric) acid. This organic acid is the 4 carbon analog to the 3 carbon propanoic acid. Operating parameters for calcium removal were:

| RD-48-1A | RD-48-1B |
|---|---|
| 875 g −100 mesh material | 872 g −60 mesh material |
| 267 ml propionic acid | 267 ml butanoic acid |
| 30.5 ml acid/100 g powder | 30.6 ml acid/100 g material |
| 682 g recovered | 677 g recovered |
| 97.4% recovery | 97.0% recovery |

| | Nominal | RD-48-1A Analyzed | RD-48-1B Analyzed |
|---|---|---|---|
| Nd | 32.5 | 31.3 | 31.5 |
| Dy | 2.8 | 2.8 | 2.9 |
| Fe | 63.4 | 63.6 | 63.6 |
| B | 1.3 | 1.12 | 1.12 |
| Ca | 0 | 0.12 | 0.10 |
| $O_2$ | 0 | 0.88 | 0.98 |
| C | 0 | 0.10 | 0.10 |

These results show that butanoic acid is equally as effective for calcium removal as propanoic acid.

EXAMPLE 6

Another revised composition was processed as described in Example 4 except that it was pulverized to −100 mesh.

RD-47-2 (weight percent)

913 g Iron powder 70% −325 mesh
614 g $Nd_2O_3$ 95% Nd 5% other rare earths
55 g $Dy_2O_3$ 10% other rare earths
110 g 18.45% B −100 mesh
308 g Ca 98% Atomized 0.2 to 2 micron particle size Operating parameters for calcium removal were:

1244 g −100 mesh material
208 ml propionic acid
16.5 ml acid/100 g powder
982 g recovered
98.8% recovery

| | Nominal | Analyzed |
|---|---|---|
| Nd | 32.0 | 32.7 |
| Dy | 2.8 | 2.9 |
| Fe | 63.9 | 63.0 |
| B | 1.3 | — |
| Ca | 0 | 0.057 |
| $O_2$ | 0 | 0.98 |

This powder was jet-milled to 2.3 microns. Magnets were pressed and sintered at 1045° C. for 3 hours. They contained various levels and combinations of sintering aid. The Alloy 4 was of substantially the same composition as used in the previous examples. The Dy sintering aid was 39.2% Dy, 56.1% Fe and 1.21% B. The magnetic properties were as follows:

| Wt % Alloy 4 | Wt % Dy Sintering Aid | Br Gauss | Hc Oe | Hci Oe | BHmax MGOe | Hk Oe |
|---|---|---|---|---|---|---|
| 0 | 0 | 11150 | 6300 | 8600 | 23.9 | 3900 |
| 0 | 2 | 11400 | 11000 | 15700 | 31.8 | 14300 |
| 5 | 0 | 11700 | 11000 | 13300 | 32.9 | 12300 |
| 5 | 4 | 11400 | 11200 | 17600 | 32.4 | 16200 |

What is claimed is:

1. A method for producing alloy particles for the production of permanent magnets said method comprising producing a compacted article comprising Ca and a rare earth oxide including at least Nd oxide, heating said article to effect Ca reduction of said rare earth oxide including at least Nd oxide, forming particles of a size of −60 mesh or finer from said article, and leaching Ca from said particles by contacting said particles with an organic acid having at least three carbon atoms.

2. The method of claim 1 wherein said organic acid is an acid selected from the group consisting of propionic acid and butanoic acid.

3. The method of claim 1 or claim 2 wherein said particles are water rinsed prior to said leaching.

4. The method of claim 1 or claim 2 or claim 3 wherein said particles after said leaching are compacted and sintered to form a consolidated article without the use of a sintering aid.

5. A method for producing alloy particles for the production of permanent magnets, said method comprising producing a compacted article comprising Ca, a rare earth oxide including at least Nd oxide, a transition element, and B, heating said article to effect Ca reduction of said rare earth oxide including at least Nd oxide, forming particles of a size of −60 mesh or finer from said article, and leaching Ca from said particles by contacting said particles with an organic acid having at least three carbon atoms.

6. The method of claim 5 wherein said organic acid is propionic acid and butanoic acid.

7. The method of claim 5 or claim 6 wherein said particles are water rinsed prior to said leaching.

8. The method of claim 5, or claim 6 wherein said particles after said leaching are compacted and sintered to form a consolidated article without the use of a sintering aid.

9. The method of claim 5, or claim 6, wherein said transition element is Fe.

10. A method for producing alloy particles for the production of permanent magnets, said method comprising producing a compacted article consisting essentially of Ca, Nd oxide, Fe and B, heating said article to effect Ca reduction of said Nd oxide, forming particles of a size of −60 mesh or finer from said article and leaching Ca from said particles by contacting said particles with an organic acid having at east three carbon atoms.

11. The method of claim 10 wherein said organic acid is an acid selected from the group consisting of propionic acid and butanoic acid.

12. The method of claim 10 or claim 11 wherein said particles are water rinsed prior to said leaching 13. The method of claim 10, or claim 11 or claim 12 wherein said particles after said leaching are sintered to form a consolidated article without the use of a sintering aid.

14. The method of claim 1, or claim 2, or claim 5, or claim 6 or claim 11 wherein said article additionally includes Dy oxide which is Ca reduced.

* * * * *

UNITED STATES PATENT AND TRADEMARK OFFICE

CERTIFICATE OF CORRECTION

PATENT NO. : 4,990,307

DATED : February 5, 1991

INVENTOR(S) : Floyd E. CAMP

It is certified that error appears in the above-identified patent and that said Letters Patent is hereby corrected as shown below:

Claim 4, column 6, line 67, delete "or claim 3".

Claim 10, column 8, line 8, change "east" to --least--.

Claim 13, column 8, line 15, delete "or claim 12".

Claim 14, column 8, line 20, after "6" insert --, or claim 10,--.

Signed and Sealed this

Second Day of June, 1992

*Attest:*

*Attesting Officer*

DOUGLAS B. COMER

*Acting Commissioner of Patents and Trademarks*